US008168873B2

(12) United States Patent
Okamoto

(10) Patent No.: US 8,168,873 B2
(45) Date of Patent: May 1, 2012

(54) DRUM SUPPORT STRUCTURE

(75) Inventor: Shigehiro Okamoto, Hamamatsu (JP)

(73) Assignee: Yamaha Corporation, Hamamatsu-Shi, Shizuoka-Ken (JP)

( * ) Notice: Subject to any disclaimer, the term of this patent is extended or adjusted under 35 U.S.C. 154(b) by 0 days.

(21) Appl. No.: 12/345,988

(22) Filed: Dec. 30, 2008

(65) Prior Publication Data

US 2009/0173211 A1 Jul. 9, 2009

(30) Foreign Application Priority Data

Jan. 9, 2008 (JP) ..... 2008-002217

(51) Int. Cl.
*G10D 3/00* (2006.01)

(52) U.S. Cl. ..... 84/411 R

(58) Field of Classification Search ..... 84/411 R, 84/421

See application file for complete search history.

(56) References Cited

U.S. PATENT DOCUMENTS

| | | | | |
|---|---|---|---|---|
| 4,158,980 | A | 6/1979 | Gauger | |
| 5,454,288 | A | 10/1995 | Hoshino | |
| 5,461,959 | A | 10/1995 | Sassmannshausen et al. | |
| 5,520,083 | A | 5/1996 | Falkner, Jr. | |
| 5,544,561 | A | 8/1996 | Isomi | |
| 5,645,253 | A * | 7/1997 | Hoshino | 248/181.1 |
| 6,239,341 | B1 * | 5/2001 | Wang | 84/421 |
| 2004/0051021 | A1 * | 3/2004 | Micheel | 248/346.01 |
| 2007/0017335 | A1 * | 1/2007 | Marwede | 84/411 R |
| 2009/0272250 | A1 * | 11/2009 | Bassam | 84/421 |

FOREIGN PATENT DOCUMENTS

JP 7-210154 A 8/1995

* cited by examiner

*Primary Examiner* — Kimberly Lockett
(74) *Attorney, Agent, or Firm* — Dickstein Shapiro LLP

(57) ABSTRACT

The drum support structure according to the present invention includes: a drum support member that is attached to a drum holding portion of a drum stand; and a coupling member that supports a drum shell and couples the drum shell to the drum support member, and the drum support member includes a base made of wood to which the coupling member is attached.

2 Claims, 7 Drawing Sheets

DRUM SUPPORT STRUCTURE

BACKGROUND OF THE INVENTION

1. Field of the Invention

The present invention relates to a drum support structure.

Priority is claimed on Japanese Patent Application No. 2008-002217, filed Jan. 9, 2008, the content of which is incorporated herein by reference.

2. Description of Related Art

Japanese Unexamined Patent Application, First Publication No. H07-210154 discloses a drum support structure that supports a drum such as a bass drum, snare drum, and tom-tom with a drum stand such as a musical instrument stand.

In this drum support structure, there is provided at least three hoop-side installation flanges that have attachment holes, and corresponding to these hoop-side installation flanges, a support member is attached to a tom holder base that is provided at a clamp of a drum holder (drum stand). This support member includes a bracket, arms, support member-side installation flanges, mounting bolts, and vibration absorbing parts. The bracket is supported by the tom holder base. The arms are disposed so as to surround part of the outer periphery of the drum hoop. The support member-side installation flanges correspond to the hoop-side installation flanges, respectively, and are attached to the arm portions. The mounting bolts secure the hoop-side installation flanges to the support member-side installation flanges. The vibration absorbing part is interposed between the mounting bolt and the hoop-side installation flange.

In the above-described conventional drum support structure, when vibration energy that is transmitted from the drum shell reaches the support member, the bracket, arms, and support member-side installation flanges that constitute this support member also vibrate. Because all of these component parts are made from metal, they resonate in the upper register. For this reason, the problem arises of not being able to emphasize the low tones of the radiated sound of the drum.

Also, since the aforementioned metal component parts have excellent vibration transmission efficiency, vibration energy ends up being transmitted to the clamp and drum holder via the support member. As a result, the vibration energy of the drum ends up being lost. For this reason, there has been the problem of not being able to obtain the desired volume and sustain (length of tone) of the drum sound.

SUMMARY OF THE INVENTION

The present invention has been conceived in order to solve the aforementioned problems and has as its object to provide a drum support structure that is capable of increasing the low-tone feeling of the radiated sound of a drum while allowing the sustain to be readily adjusted.

In order to achieve the aforementioned object, the drum support structure according to the present invention includes: a drum support member that is attached to a drum holding portion of a drum stand; and a coupling member that supports a drum shell and couples the drum shell to the drum support member, and the drum support member includes a base made of wood to which the coupling member is attached.

In the drum support structure according to the present invention, the coupling member may include a vibration absorbing member and two mounting bolts and also may serve as a sustain adjusting portion.

In the drum support structure according to the present invention, a required number of the sustain adjusting portions may be attached to the base in accordance with weight of the drum shell.

In the drum support structure according to the present invention, a required number of the sustain adjusting portions may be selectively attached to the base to adjust sustain.

In the present invention, the drum support member includes a base made of wood. This base resonates at a low-frequency range, and thereby increases the low-range feeling of the radiated sound of a drum. Accordingly, it is possible to obtain a tone that is audibly sonorous and large.

Further, according to the embodiment of the present invention, the coupling member also serves as a sustain adjusting portion. Since the vibration absorbing member of this coupling member isolates the drum shell from the drum support member, vibration energy of the drum is hard to get lost. So, it is possible to adjust sustain and longer sustain can be obtained.

Moreover, according to the embodiment of the present invention, since the number of sustain adjusting portions is changed in accordance with the weight of the drum shell, it is possible to adjust the sustain. That is, since a shell with a heavy weight intrinsically extends for too long, by increasing the number of sustain adjusting portions to increase the loss of vibration energy, it is possible to shorten the sustain. Conversely, in the case of a lightweight shell, since the sustain is intrinsically short, by reducing the number of sustain adjusting portions to reduce the loss of vibration energy, it is possible to lengthen the sustain. Thus it is possible to uniformly adjust sustain regardless of the shell weight.

Furthermore, according to the embodiment of the present invention, since a required number of the sustain adjusting portions are selectively attached, it is possible to freely adjust the sustain in accordance with the preference of the performer or the piece being performed regardless of the shell weight.

DETAILED DESCRIPTION OF THE INVENTION

Hereinafter, embodiments of the present invention will be described in detail with reference to the drawings.

Figure 1:
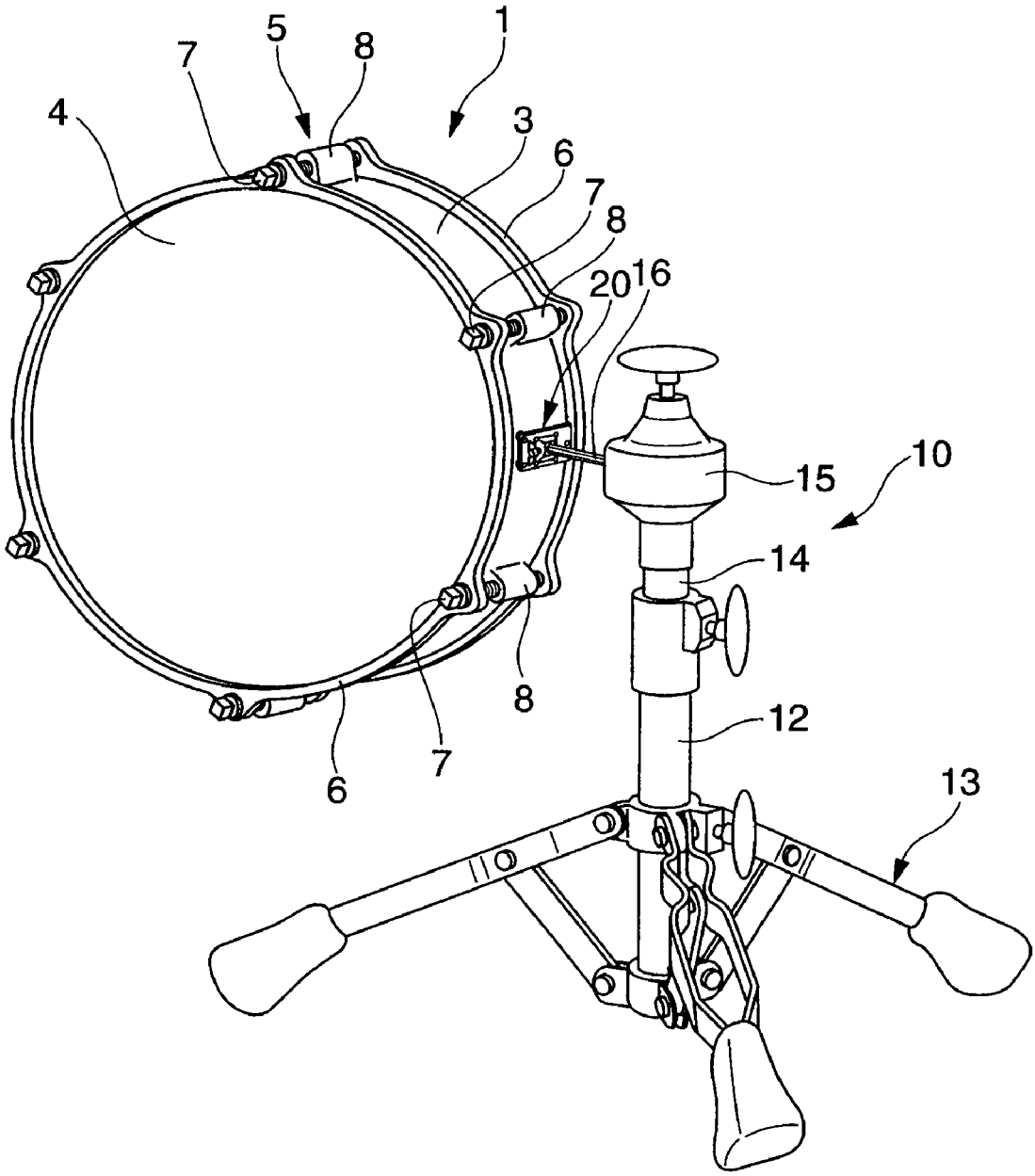
FIG. 1 is an external peripheral view showing a drum support structure according to an embodiment of the present invention.
Figure 2:
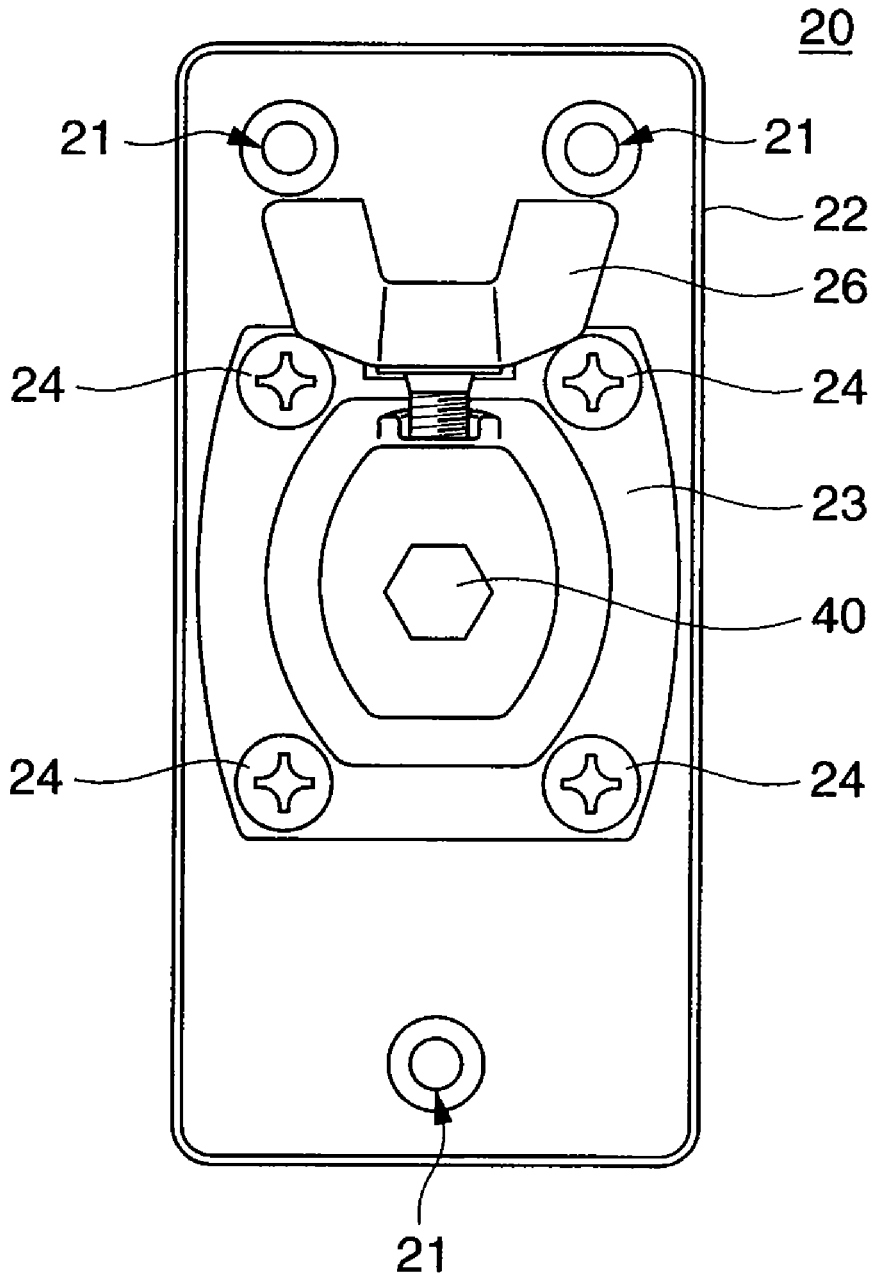
FIG. 2 is a front view showing the drum support member according to the embodiment of the present invention.
Figure 3:
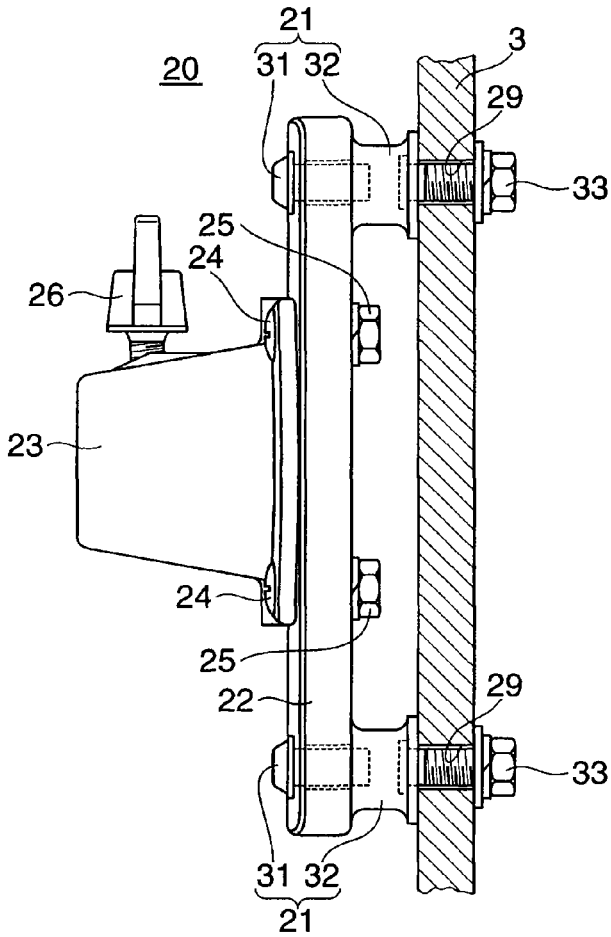
FIG. 3 is a cross-sectional side view showing the drum support member according to the embodiment of the present invention.
Figure 4:
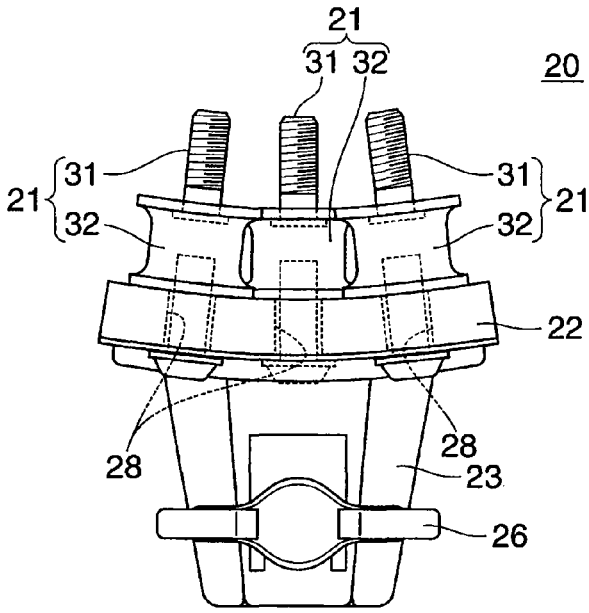
FIG. 4 is a plan view showing the drum support member according to the embodiment of the present invention.
Figure 5:
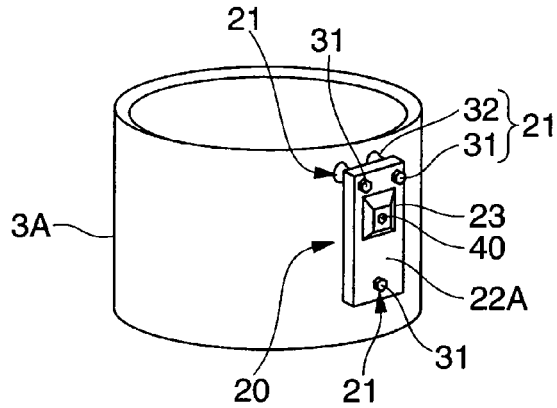
FIG. 5 is a perspective view showing the state of the drum support member according to the embodiment of the present invention attached to a small shell.
Figure 6:
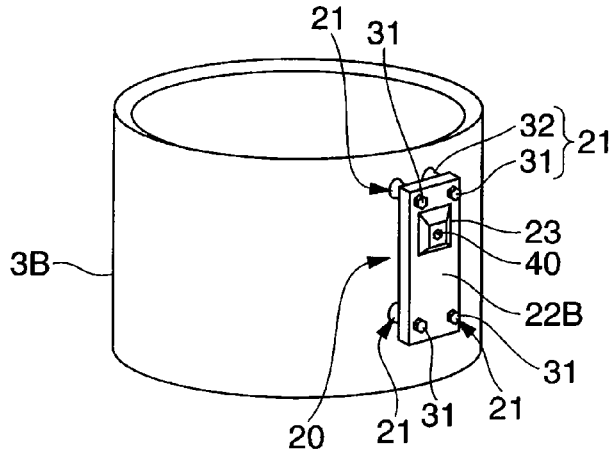
FIG. 6 is a perspective view showing the state of the drum support member according to the embodiment of the present invention attached to a medium-size shell.
Figure 7:
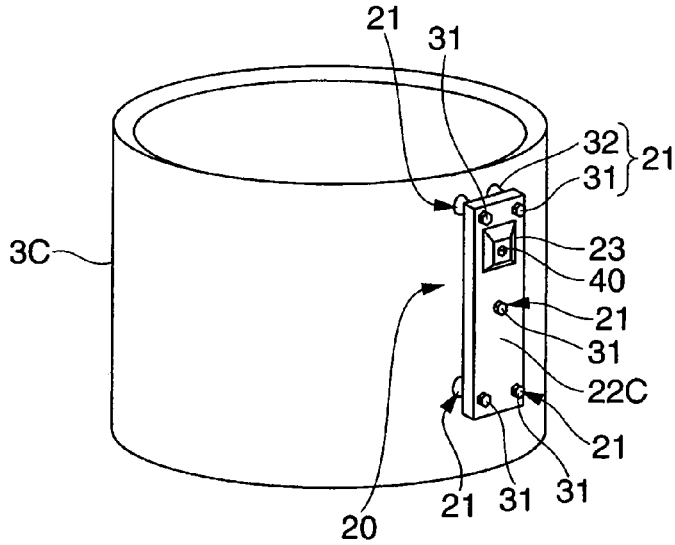
FIG. 7 is a perspective view showing the state of the drum support member according to the embodiment of the present invention attached to a large shell.

FIG. 1 is an external perspective view showing a drum support structure according to an embodiment of the present invention. FIG. 2 is a front view showing the drum support member according to the embodiment of the present invention. FIG. 3 is a cross-sectional side view showing the drum support member according to the embodiment of the present invention. FIG. 4 is a plan view showing the drum support member according to the embodiment of the present invention. FIG. 5 is a perspective view showing the state of the drum support member according to the embodiment of the present invention attached to a small shell. FIG. 6 is a perspective view showing the state of the drum support member according to the embodiment of the present invention attached to a medium-size shell. FIG. 7 is a perspective view showing the state of the drum support member according to the embodiment of the present invention attached to a large shell. FIG. 2 to FIG. 4 show the drum support member attached to a small shell. The present embodiment describes a drum support structure in which a drum 1 is supported with a musical instrument stand 10 that is a drum stand with reference to these drawings.

A drum 1 includes a shell 3, two drum heads 4, and a head supporting and tensioning portion 5. The shell 3 is formed in a cylindrical shape and both its ends are opened. The two drum heads 4 are disposed under tension so as to cover each opening of this shell 3. The head supporting and tensioning portion 5 supports and tensions these drum heads 4.

The shell 3 is made of wood. As shown in FIG. 5 to FIG. 7, shells 3A, 3B and 3C having three sizes of small, medium, and large of differing diameters are used. The small shell 3A has for example two types of diameters: 10 inches (25.4 cm) and 12 inches (30.48 cm). The medium size shell 3B has a diameter of for example 13 inches (33.02 cm) or 14 inches (35.56 cm). The large shell 3C has a diameter of for example 15 inches (38.20 cm) or 16 inches (40.64 cm). A drum support member 20 (20A to 20C) described below is attached to the peripheral surface of such a shell 3 (3A to 3C).

The head supporting and tensioning portion 5 is constituted with a pair of head frames (not illustrated), a pair of hoops 6, a plurality of lug bolts 7, and a plurality of lugs 8. The pair of head frames respectively hold the periphery of each drum head 4 and are fitted over on the periphery of the shell 3. The pair of hoops 6 respectively press down on these head frames. The plurality of lug bolts 7 couple these hoops 6. The plurality of lugs 8 are respectively fixed to the peripheral surface of the shell 3, and the lug bolts 7 are attached to them.

A musical instrument stand 10 is well known, and is constituted by a tubular column body 12, a tripod 13, a sliding column 14, a clamp portion 15, a support rod 16 and the like. The tripod 13 is attached to the column body 12 in a freely opening and closing manner. The sliding column 14 is fitted by insertion into the column body 12 in a telescopic manner. The clamp portion 15 is attached to the upper end of this slide column 14. The support rod 16 is provided at this clamp portion 15 and supports the drum support member 20.

The support structure that supports the drum 1 with the musical instrument stand 10 is constituted by the drum support member 20 and a plurality of coupling members 21 that couple this drum support member 20 and the drum shell 3.

The drum support member 20 is constituted by a base 22 made of wood, a clamp member 23, a thumbscrew 26 and the like. The base 22 is formed as a rectangular plate having a suitable thickness and hardness. The clamp member 23 is fixed by four locking screws 24 and nuts 25 to the center of the surface of the base 22. The thumbscrew 26 screws into this clamp member 23. The base 22 is formed to a size corresponding to the respective size of the shells 3A, 3B and 3C as shown in FIG. 5 to FIG. 7. Thereby, three bases 22A, 22B and 22C of small, medium and large sizes are prepared. As the material of the base 22, plywood or timber (such as maple, birch, beech, oak, mahogany, kapur, rosewood, or the like) is used.

A plurality of coupling members 21 are attached to each base 22A, 22B and 22C. The number of coupling members 21 to be attached differs according to the weight (size, depth of the shell) of the shell 3 of the drum 1 in order to adjust the sustain (length of tone). As shown in FIG. 5, three coupling members 21 are attached to the base 22A that is attached to the small shell 3A with a light weight. As shown in FIG. 6, four coupling members 21 are attached to the base 22B that is attached to the medium size shell 3B with a moderate weight. As shown in FIG. 7, five coupling members 21 are attached to the base 22C that is attached to the large shell 3C with a heavy weight. That is, the coupling members 21 serve also as sustain adjusting portions. Since the tone of a large drum with a heavy weight extends for too long, more of the coupling members 21 are used. Thereby, the loss of vibration energy by the coupling members 21 is increased, and the sustain is shortened. Conversely, since it is difficult to extend the tone of a small drum with a light weight, the number of coupling members 21 used is reduced. Thereby, the loss of vibration energy by the coupling members 21 is reduced as much as possible, and the sustain is prolonged.

For this reason, three mounting holes 28 are formed in the small base 22A to which the three coupling members 21 are respectively attached (refer to FIG. 4). Four mounting holes 28 are formed in the medium size base 22B to which the four coupling members 21 are respectively attached. Five mounting holes 28 are formed in the large base 22C to which the five coupling members 21 are respectively attached. In the small base 22A, two mounting holes 28 are formed at one end side in the lengthwise direction, and one is formed at the other end side. In the medium-size base 22B, two mounting holes 28 are formed at both end portions in the lengthwise direction. In the large base 22C, two mounting holes 28 are formed at both end portions in the lengthwise direction and one is formed in the center. In the shells 3A, 3B, 3C of each size, bolt insertion holes 29 are formed to the same number as the mounting holes 28 in each base 22A, 22B and 22C (refer to FIG. 3).

The coupling member 21 includes two mounting bolts 31, a vibration absorbing member 32 made of rubber or silicon rubber, and a nut 33. One of the mounting bolts 31 can be removably screwed to the vibration absorbing member 32, and the other mounting bolt 31 is attached to the vibration absorbing member 32. The mounting bolts 31 are inserted in each mounting hole 28 of the base 22 and the bolt insertion hole 29 of the shell 3. One of the mounting bolts 31 is screwed through the mounting hole 28 to the vibration absorbing member 32 to fix the vibration absorbing member 32 to the base 22. The other mounting bolt 31 fixes the base 22 to the peripheral surface of the shell 3 by the nut 33 being screwed on from the inside of the shell 3. The vibration absorbing member 32 is fitted to the mounting bolts 31, and positioned between the shell 3 and the base 22. The vibration absorbing member 32 is pushed by the base 22 against the peripheral surface of the shell 3 by tightening of the nut 33.

The clamp member 23 is made of a metal such as zinc or an aluminum alloy, and is formed in a trapezoidal shape. A hexagonal rod hole 40 in which the support rod 16 of the musical instrument stand 10 is inserted is formed in the center of the distal end surface of the clamp member 23. The clamp member 23 is formed with a uniform size regardless of the size of each base 22A, 22B and 22C. The support rod 16 is a hexagonal rod that fits the rod hole 40. The support rod 16 is removably inserted in the rod hole 40, and fixed by the thumbscrew 26.

In the embodiment of the present invention, the base 22 of the drum support member 20 is made of wood. For this reason, when the vibration energy of the shell 3 is transmitted to the base 22 via the coupling members 21 during playing of the drum 1, since the base 22 resonates in the low-frequency range, it is possible to increase the low range of the radiated sound of the drum. Thereby, it is possible to obtain a tone color that is audibly sonorous and massive. That is, it is possible to provide a drum with an emphasized low range.

Also, in the embodiment of the present invention, by constituting the coupling member 21 with the mounting bolts 31 and the vibration absorbing member 32, the vibration energy of the drum is made to be not transmitted to the musical instrument stand 10 by the vibration absorbing member 32. For this reason, it is possible to reduce the loss of vibration energy due to the musical instrument stand 10. In this case, it is not possible to completely prevent transmission of vibration energy to the musical instrument stand 10 by the vibration absorbing member 32. However, since the base 22 made of wood is additionally interposed between the vibration absorbing member 32 and the musical instrument stand 10, it is possible to make the transmission of vibration energy to the musical instrument stand 10 low and it is possible to make the entire drum vibrate effectively, and thereby it is possible to obtain a large volume.

Figure 8:
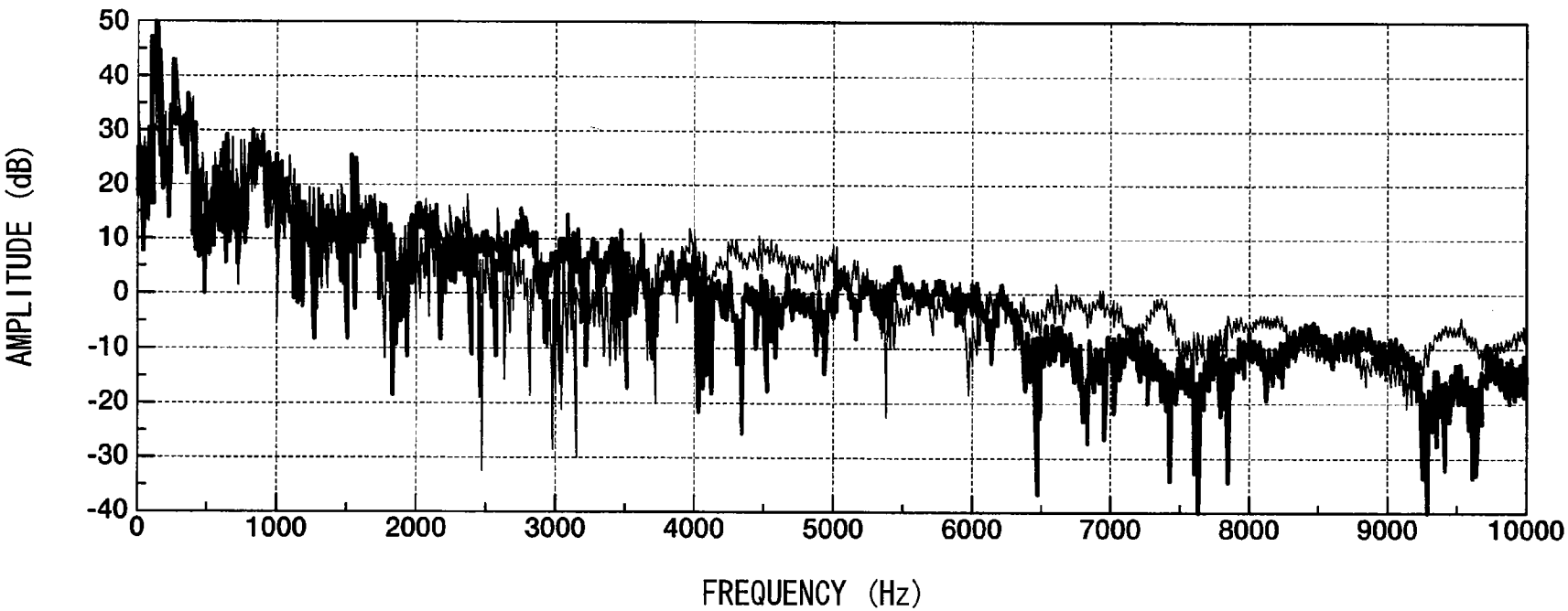
FIG. 8 is a graph showing the frequency range in the case of manufacturing the base with wood and with metal.

FIG. 8 is a graph showing the frequency range in the case of manufacturing the bases with wood and with metal. In FIG. 8, a thick line denotes the frequency range in the case of the base being made of wood, while a thin line denotes the frequency range in the case of the base being made of metal. As is apparent from this graph, when using the base made of wood, it is possible to suppress vibrations in the high-frequency range of 6,000 Hz and higher (considered to be generated by resonance of a stand) which are offensive to the ears compared to the base made of metal.

Also, in the embodiment of the present invention, with respect to the shells 3A, 3B and 3C of each size (diameter, depth) whose weight differs, the number of coupling members 21 that fix the bases 22A, 22B and 22C to the shells 3A, 3B and 3C, respectively, is varied. That is, for the small shell 3A with a light weight, the number of coupling members 21 used is reduced, while for the large shell 3C with a heavy weight the number of coupling members 21 used is increased. For this reason, it is possible to make the sustain approximately uniform regardless of the weight of the shells 3A, 3B and 3C. In other words, since the tone of the large shell 3C with a heavy weight intrinsically extends for too long, increasing the number of coupling members 21 increases the loss of vibration energy by the vibration absorbing members 32. Thereby, it is possible to shorten the sustain. Conversely, in the case of the small shell 3A with a light weight, since the tone is intrinsically short, reducing the number of coupling members 21 reduces the loss of vibration energy by the vibration absorbing members 32. Thereby, the sustain is relatively prolonged, and it is possible to bring the sustain of the heavy shell 3B or shell 3C closer to an appropriate length.

Figure 9:
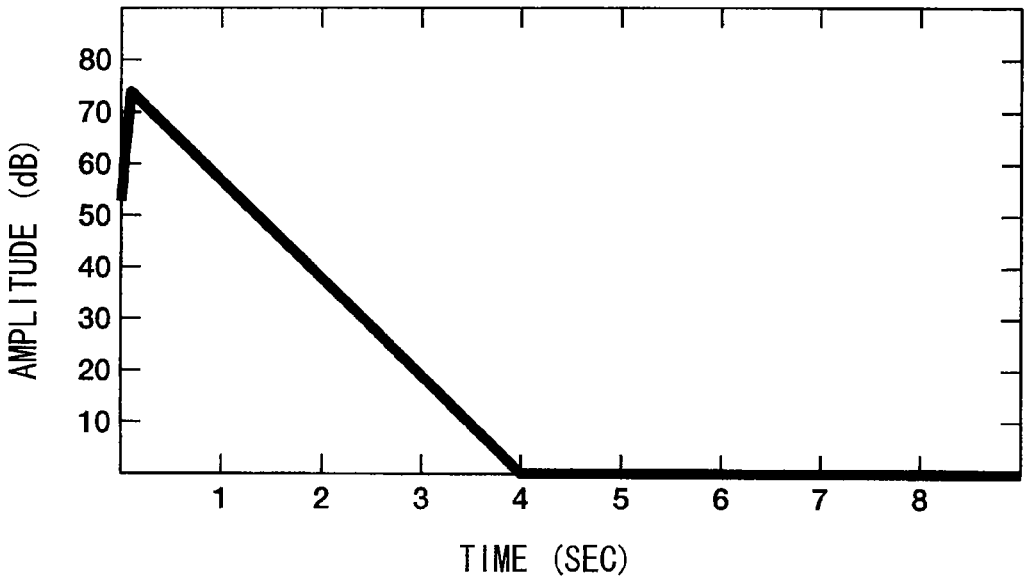
FIG. 9 is a graph showing the sustain in the case of using four coupling members according to the embodiment of the present invention.
Figure 10:
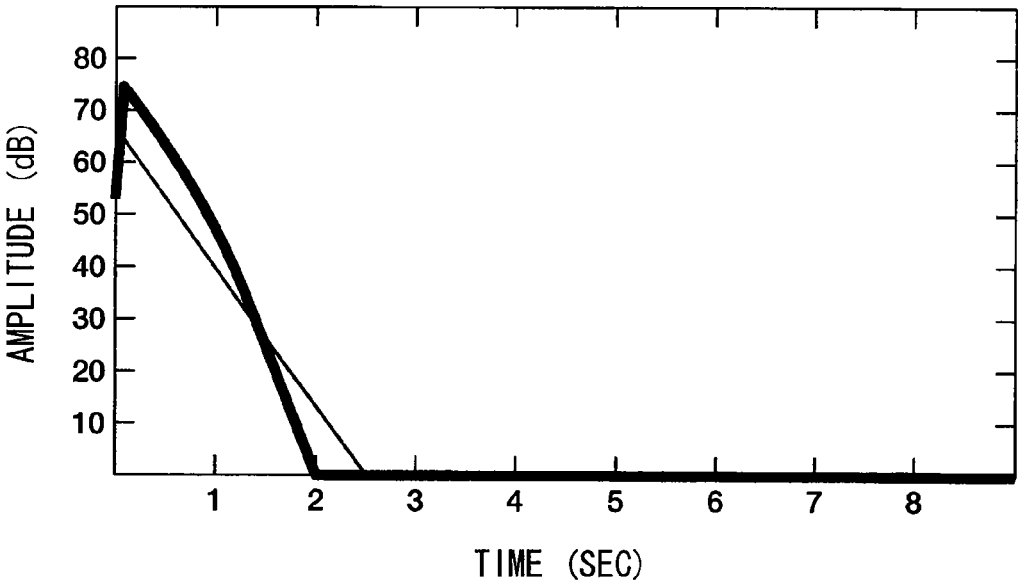
FIG. 10 is a graph showing the sustain in the case of using five coupling members.

FIG. 9 is a graph showing the sustain in the case of using four coupling members. FIG. 10 is a graph showing the sustain in the case of using five coupling members.

As is evident in these graphs, using five of the coupling members 21 results in faster tone attenuation compared to the case of using four.

Figure 11:
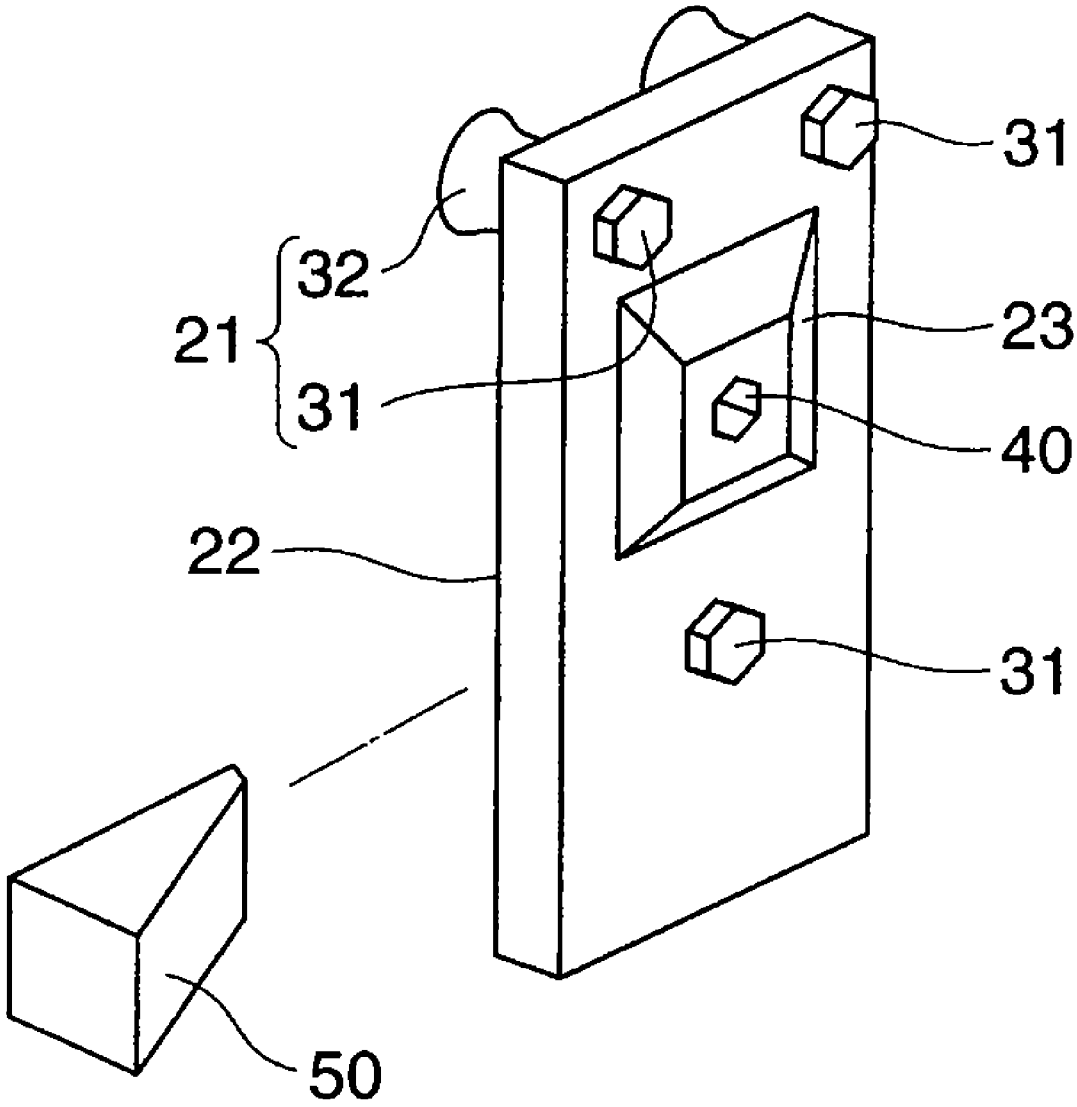
FIG. 11 is a perspective view showing the base according to another embodiment of the present invention.

Adjustment of sustain can also be changed in accordance with the preference of the performer and the piece being performed instead of depending on the weight of the shells 3A, 3B and 3C as described above. That is, in the case of wanting to make the sustain longer than usual, the number of coupling members 21 may be suitably made fewer than normal. Specifically, in the case of the small shell 3A for example, the number of coupling members 21 may be made one fewer than normal. In the case of the medium size shell 3B, the number of coupling members 21 may similarly be made one or two fewer than normal. And in the case of the large shell 3C, the number of coupling members 21 may be made one, two, or three fewer than normal. On the other hand, in the case of wanting to make the sustain shorter than usual, as shown for example in FIG. 11, a suitable number of wedge-shaped vibration absorbing members 50 formed with rubber, silicon rubber, styrene foam, and the like may be interposed between the shell and the base 22. Alternatively, a screw hole for adjusting sustain may be formed in advance in the base 22, and by attaching to this screw hole a sustain adjusting portion including a bolt and a vibration absorbing member similar to those of the coupling member 21, the distal end of the vibration absorbing member may be brought into contact with the peripheral surface of the shell body.

By using such sustain adjusting portions, it is possible to freely adjust the sustain with no need to subject the shell 3 itself to any processing.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A drum support structure comprising:

a drum support member that is attached to a drum holding portion of a drum stand;

a coupling member that supports a drum shell and fixedly couples the drum shell to the drum support member, wherein the coupling member includes a vibration absorbing member and two mounting bolts and also serves as a sustain adjusting portion; and the drum support member including a base made of wood to which the coupling member is attached, wherein a required number of the sustain adjusting portions are attached to the base in accordance with weight of the drum shell.

2. A drum support structure comprising:

a drum support member that is attached to a drum holding portion of a drum stand;

a coupling member that supports a drum shell and fixedly couples the drum shell to the drum support member, wherein the coupling member includes a vibration absorbing member and two mounting bolts and also serves as a sustain adjusting portion; and the drum support member including a base made of wood to which the coupling member is attached, wherein a required number of the sustain adjusting portions are selectively attached to the base to adjust sustain.

* * * * *